United States Patent [19]

Clumpner

[11] 4,177,066

[45] Dec. 4, 1979

[54] METHOD AND APPARATUS FOR THE REMOVAL OF IMPURITIES FROM MOLTEN METAL

[75] Inventor: Joseph A. Clumpner, Creve Coeur, Mo.

[73] Assignee: Swiss Aluminium Ltd., Chippis, Switzerland

[21] Appl. No.: 13,029

[22] Filed: Feb. 21, 1979

Related U.S. Application Data

[63] Continuation-in-part of Ser. No. 914,511, Jun. 12, 1978.

[51] Int. Cl.[2] ..... C22B 9/02; C22B 9/08

[52] U.S. Cl. ..... 75/93 E; 75/68 R; 266/218; 266/227; 266/233

[58] Field of Search ..... 266/218, 227, 233; 75/68 R, 93 R, 93 E

[56] References Cited

U.S. PATENT DOCUMENTS

| | | | |
|---|---|---|---|
| 3,015,554 | 1/1962 | Rummel | 75/93 R X |
| 3,311,467 | 3/1967 | Polishouk et al. | 75/93 E |
| 3,317,311 | 5/1967 | Davey | 266/227 X |
| 3,677,742 | 7/1972 | Toth | 75/68 R |
| 4,052,199 | 10/1977 | Mangalick | 75/93 E |

*Primary Examiner*—M. J. Andrews

*Attorney, Agent, or Firm*—Bachman and LaPointe

[57] ABSTRACT

The disclosure teaches an improved design for a swirling tank reactor for use in the degassing and filtration of molten metal. The swirling tank reactor has a larger first cylindrical section and a second smaller cylindrical or converging conical section located beneath said first cylindrical section. Conical shaped fluxing gas inlet nozzles are provided in the walls of both the first and second sections so as to maximize fluxing gas bubble dispersion.

30 Claims, 7 Drawing Figures

METHOD AND APPARATUS FOR THE REMOVAL OF IMPURITIES FROM MOLTEN METAL

CROSS REFERENCE TO RELATED APPLICATION

This application is a Continuation-In-Part of co-pending application Ser. No. 914,511, filed June 12, 1978.

BACKGROUND OF THE INVENTION

The present invention relates to the treatment of liquids with gases and more particularly to the degassing of molten metal. Molten metal, particularly molten aluminum in practice, generally contains entrained and dissolved impurities both gaseous and solid which are deleterious to the final cast product. These impurities may affect the final cast product after the molten metal is solidified whereby processing may be hampered or the final product may be less ductile or have poor finishing and anodizing characteristics. The impurities may originate from several sources. For example, the impurities may include metallic impurities such as alkaline and alkaline earth metals and dissolved hydrogen gas and occluded surface oxide films which have become broken up and are entrained in the molten metal. In addition, inclusions may originate as insoluble impurities such as carbides, borides and others or eroded furnace and trough refractories.

One process for removing gaseous impurities from molten metals is by degassing. The physical process involves injecting a fluxing gas into the melt. The hydrogen enters the purged gas bubbles by diffusing through the melt to the bubble where it adheres to the bubble surface and is adsorbed into the bubble itself. The hydrogen is then carried out of the melt by the bubble.

It is naturally highly desirable to improve the degassing of molten metals in order to remove or minimize such impurities in the final cast product, particularly with respect to molten aluminum and especially, for example, when the resultant metal is to be used in a decorative product such as a decorative trim or products bearing critical specifications such as aircrafts forgings and extrusions and light gauge foil stock. Impurities as aforesaid cause loss of properties such as tensile strength and corrosion resistance in the final cast product.

Rigorous metal treatment processes such as gas fluxing or melt filtration have minimized the occurrence of such defects. However, while such treatments have generally been successful in reducing the occurrence of such defects to satisfactory levels, they have been found to be inefficient and/or uneconomical. Conventionally conducted gas fluxing processes such as general hearth fluxing have involved the introduction of the fluxing gas to a holding furnace containing a quantity of molten metal. This procedure requires that the molten metal be held in the furnace for significant time while the fluxing gas is circulated so that the metal being treated would remain constant and treatment could take place. This procedure has many drawbacks, among them, the reduced efficiency and increased cost resulting from the prolonged idleness of the furnace during the fluxing operation and more importantly, the lack of efficiency of the fluxing operation due to poor coverage of the molten metal by the fluxing gas which is attributable to the large bubble size and poor bubble dispersion within the melt. Further factors comprise the restriction of location to the furnace which permits the re-entry of impurities to the melt before casting, and the high emissions resulting from both the sheer quantity of flux required and the location of its circulation.

As an alternative to the batch-type fluxing operations employed as aforesaid, certain fluxing operations were employed in an inline manner; that is, the operation and associated apparatus were located outside the melting or holding furnace and often between the melting furnace and either the holding furnace or the holding furnace and the casting station. This helped to alleviate the inefficiency and high cost resulting from furnace idleness when batch fluxing but was not successful in improving the efficiency of the degassing operation itself, in that the large size of the units and the undesirably large quantities of fluxing gas required per unit of molten metal were both costly and detrimental to air purity.

A typical inline gas fluxing technique is disclosed in U.S. Pat. No. 3,737,304. In the aforenoted patent, a bed of "stones" is positioned in a housing through which the molten metal will pass. A fluxing gas is introduced beneath the bed and flows up through the spaces between the stones in counter flow relationship with the molten metal. The use of a bed of porous "stones" has an inherent disadvantage. The fact that the stones have their pores so close together results in the bubbles passing through the stones coalescing on their surfaces and thus creating a relatively small number of large bubbles rather than a large number of small bubbles. The net effect of the bubbles coalescing is to reduce the surface area of bubble onto which the hydrogen can be adsorbed thus resulting in low degassing efficiency.

One improved method and apparatus for the inline degassing and filtration of molten metal is disclosed in U.S. Pat. No. 4,052,198 to Yarwood et al. and assigned to the assignee of the present invention. The disclosure teaches an improvement in the degassing and filtration of molten metal using an apparatus which employs a pair of sequentially placed, removable filter-type elements and at least one fluxing gas inlet positioned therebetween. The fluxing gas is introduced into the melt through the inlet and flows through the first of said plates in countercurrent contact with the melt. The filter plate serves to break up the fluxing gas into a fine dispersion to insure extensive contact with the melt. The filter plates employed are made of porous ceramic foam materials which are useful for the filtration of molten metal for a variety of reasons included among which are their excellent filtration efficiencies resulting from their uniform controllable pore size, low cost as well as ease of use and replaceability. The ceramic foam filters are convenient and inexpensive to prepare and easily employed in an inline degassing and filtration unit.

While the aforenoted U.S. Pat. No. 4,052,198 offers significant improvements over those inline gas fluxing techniques previously known in the art, a number of problems have been encountered. It is desirable for economic advantages and increased productivity to have degassing and filtration systems which can treat molten metal continuously at a rate commensurate with the casting practices. The employment of known inline degassing units such as aforenoted U.S. Pat. No. 3,737,304 for continuous degassing and filtration have been found to be inefficient, thus requiring large multiple chamber arrangements necessary to sufficiently treat the quantities of molten metal which are required for continuous casting operations. As a result of the large size of the treatment units, supplemental heating is required to prevent freeze up of the molten metal as it is being treated. While some improvement in the quantity of molten metal which can be treated has been achieved by using a smaller system such as that disclosed in U.S. Pat. No. 4,052,198 which utilizes ceramic filters and countercurrent gas flow, such a system has been found to have a limited effectiveness in the quantity of molten metal which can be treated due to the large pressure drops encountered in the simultaneous countercurrent flow of gas and metal through the filter body. As a result of the large pressure drop, a large head of molten metal is developed upstream of the filter element thus requiring either an increase in size of the transfer passageway upstream of the filter element or a decrease in the rate of feeding the molten metal to the treatment unit. In addition to the limited effectiveness of the quantity of molten metal which can be treated in the aforenoted U.S. patent, it has been found that the efficiency of the degassing process leaves much to be desired since it has been found that the fluxing gas bubbles tend to coalesce thereby limiting the efficiency of the kinetics of the adsorption reaction.

The method and apparatus for inline gas fluxing disclosed in co-pending application Ser. No. 914,511 offers significant improvements over known methods and apparatuses. The disclosure teaches an improvement in the degassing and filtration of molten metal, especially aluminum, using an apparatus which employs a swirling tank reactor. The swirling tank reactor is in the form of a substantially cylindrical chamber and is characterized by having a liquid inlet at the top thereof and at least one gas inlet at the bottom of said substantially cylindrical chamber wherein at least either the liquid inlet or the gas inlet is positioned with respect to the wall of the cylindrical chamber for tangentially introducing either liquid or gas such that the liquid swirlingly flows from said liquid inlet to a liquid outlet. In a preferred embodiment for the degassing and filtration of molten metal, a filter-type medium is positioned beneath said molten metal inlet to filter the molten metal prior to delivering the same to a casting station. Dissolved gases and nonmetallic inclusions are thereby abstracted and removed from the melt.

While the above-noted swirling tank reactor is superior to known prior art inline degassing apparatuses a number of disadvantages have been encountered as the diameter of the swirling tank reactor is increased. In particular, as the diameter of the swirling tank reactor increases the fluxing gas bubble dispersion at the center of the tank decreases thereby having an adverse effect on the degassing operation. In addition to the foregoing, it has been found that a conical shaped fluxing gas inlet nozzle is preferred over a flat profiled nozzle in that it eliminates undesirable deposits on the nozzle tip which can ultimately lead to clogging of the orifice.

Accordingly, it is a primary object of the present invention to provide an improved method and apparatus for treating liquids with gases.

It is the principal object of the present invention to provide an improved method and apparatus for the degassing and filtration of molten metal which utilizes a swirling tank reactor characterized by a tangential inlet for the molten metal.

It is a particular object of the present invention to provide an improved swirling tank reactor and fluxing gas inlet which minimizes fluxing gas bubble coalescence and maximizes bubble dispersion.

It is still a further object of the present invention to provide an improved filtering and degassing apparatus which allows for an increase in the quantity of molten metal which can be effectively treated.

It is still a further object of the present invention to provide improvements as aforesaid which are convenient and inexpensive to utilize and which result in highly efficient degassing and filtration.

Further objects and advantages of the present invention will appear hereinbelow.

SUMMARY OF THE INVENTION

In accordance with the present invention, the foregoing objects and advantages are readily obtained.

The present invention comprises an improved method and apparatus for treating liquids with gases and more specifically for use in the degassing and filtration of molten metal, especially aluminum. A preferred embodiment of the present invention comprises a highly efficient degassing and filtration apparatus comprising an elongated substantially cylindrical chamber having a metal inlet at the top thereof and a metal outlet at the bottom. While in the preferred embodiment the chamber is shown as being cylindrical, it should be appreciated that the shape of the chamber could be in an octagon shape or the like as long as the shape allows the metal to flow in a swirling rotating fashion as it passes from the inlet of the chamber to the outlet thereof. In order to achieve the desired swirling flow of molten metal from the metal inlet to the metal outlet, it is a requirement that the metal inlet is positioned with respect to the cylindrical chamber wall so as to tangentially introduce the liquid. In the preferred embodiment, a plurality of fluxing gas inlet nozzles are located in the chamber wall below the metal inlet and preferably between the metal inlet and the metal outlet.

In accordance with the present invention, in order to achieve maximum fluxing gas bubble dispersion the location of the fluxing gas nozzles are varied with respect to the central axis of the swirling tank reactor. In addition, the nozzles may be, if desired, located at various heights with respect to the outlet of the tank. In the preferred embodiment of the present invention, the nozzle tips are conical shaped so as to prevent deposit build up in the area of the orifice of the nozzle which can lead to clogging of the nozzle. A filter-type medium provided with an open cell structure characterized by a plurality of interconnected voids may be positioned in the cylindrical chamber between the metal inlet and the metal outlet and ideally downstream of the fluxing gas inlet nozzles. Alternatively, the filter may be located in a separate system mounted downstream of the metal outlet of the swirling tank reactor.

In accordance with the method of the present invention, degassing of molten metal is conducted by passing the metal through the cylindrical chamber from the metal inlet to the metal outlet wherein the metal is brought into swirling contact with a fluxing gas while the metal flows downwardly as it continues to rotate until it finally leaves the chamber through the outlet.

The method of the present invention may employ a fluxing gas such as an inert gas, preferably carrying a small quantity of an active gaseous ingredient such as chlorine or a fully halogenated carbon compound. The gas used may be any of the gases or mixtures of gases such as nitrogen, argon, chlorine, carbon monoxide, Freon 12, etc., that are known to give acceptable degassing. In the preferred embodiment for the degassing of molten aluminum melts, mixtures of nitrogen-dichlorodifluoromethane, argon-dichlorodifluoromethane, nitrogen-chlorine or argon-chlorine are used. In addition, an inert gaseous cover such as argon, nitrogen, etc. may be located over the surface of the molten metal to minimize the readsorption of gaseous impurities at the surface of the melt.

The present apparatus and method provide a considerable increase in productivity in the degassing of molten metal as degassing is continued without interruptions of the melting furnace. Further, the design of the apparatus enables its placement near to the casting station whereby the possibility of further impurities entering the melt are substantially eliminated. The employment of the method and apparatus of the present invention provides a considerable improvement in the degassing of molten metal by optimizing the efficiency of the adsorption of the gaseous impurities.

The apparatus of the present invention minimizes the bubble size of the purged gas while maximizing the gas bubble dispersion thereby increasing the effective surface area for carrying out the adsorption reaction thus optimizing the degassing of the molten metal.

In addition, the efficiency of the present invention permits degassing to be conducted with a sufficiently lower amount of flux material whereby the level of effluence resulting from the fluxing operation is greatly reduced.

By virtue of the employment of a filter-type medium within the cylindrical chamber or downstream thereof, the apparatus and method of the present invention are capable of achieving levels of melt purity heretofore attainable only with the most rigorous of processing.

DETAILED DESCRIPTION

Figure 1:
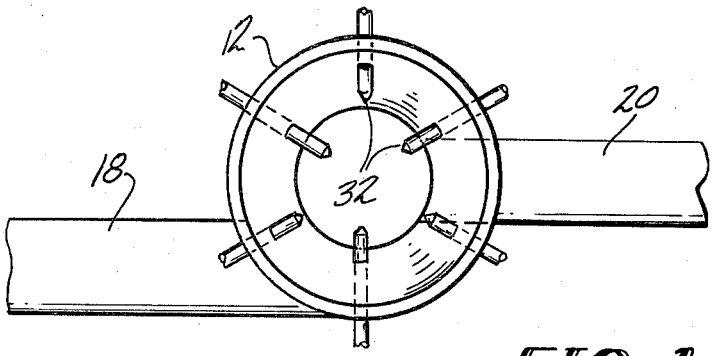
FIG. 1 is a schematic top view of a first embodiment of an apparatus in accordance with the present invention.
Figure 2:
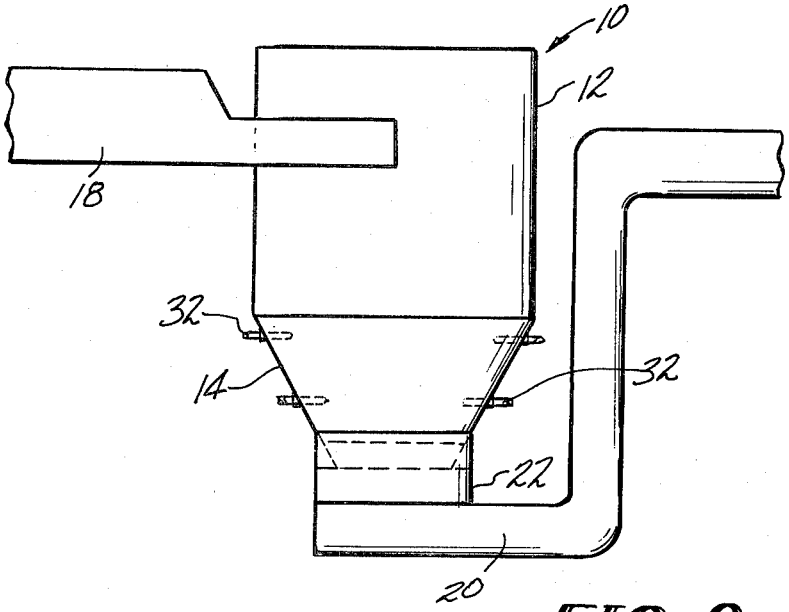
FIG. 2 is a schematic side view of the embodiment of FIG. 1.
Figure 3:
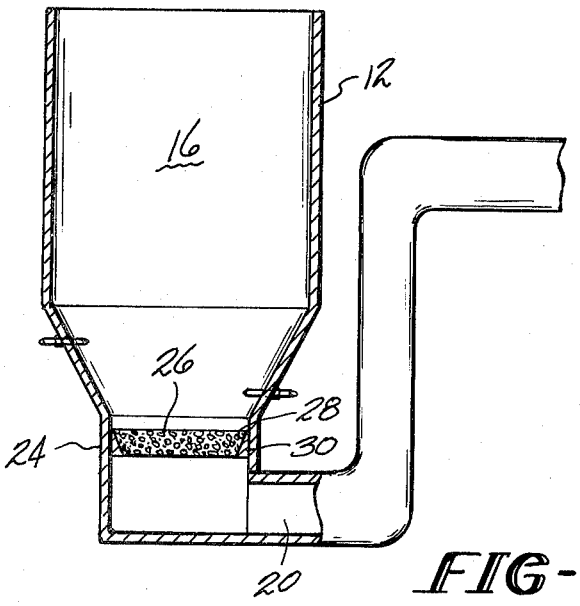
FIG. 3 is a schematic sectional view of the embodiment of FIG. 1.

Referring to FIGS. 1–5, the various embodiments of the apparatus of the present invention are illustrated in location as a molten metal transfer system which may include pouring pans, pouring troughs, transfer troughs, metal treatment bays or the like. FIGS. 1–3 illustrate a swirling tank reactor 10 having a first substantially cylindrical side wall portion 12 and a second downwardly converging side wall portion 14 which together form degassing chamber 16. While the first side wall portion 12 is illustrated as being substantially cylindrical in shape it should be appreciated that the same could be octagonal shape or any other shape which would allow for the metal to flow in a swirling rotating fashion as it passes through the degassing chamber 16. Molten metal enters the degassing chamber 16 through an inlet launder 18 located at the top of the chamber 16 and positioned tangentially with respect to first side wall portion 12 and exits therefrom through outlet launder 20 located at the bottom of chamber 16. Thus, the molten metal tangentially enters the degassing chamber 16 and flows in a swirling rotating fashion through chamber 16 and out the outlet launder 20. As illustrated in FIGS. 1–3, if desired, a substantially cylindrical side wall section 22 may be provided beneath the downwardly sloping converging side wall section 14 and be adapted to receive an appropriate filter type medium. As can best be seen in FIG. 3, cylindrical side wall portion 22 is provided with a peripheral rim 24 positioned upstream of the outlet means 20 and in proximate location therewith. The peripheral rim 24 as illustrated defines a downwardly converging bevelled surface which enables for the installation and replacement of an appropriately configured filter type medium 26. The filter type medium 26 has a corresponding bevelled peripheral surface 28 provided with resilient seal means 30 which is attached by means of press fit to sealingly mate with peripheral rim 24 and side wall portion 22. It should be appreciated that the filter element need not be incorporated in the side wall portion 22 but may be mounted as a separate assembly downstream from the swirling tank reactor 10. In addition, an inert gaseous cover such as argon, nitrogen, etc., not shown, may be provided over the top of chamber 16 so as to minimize the readsorption of gaseous impurities at the surface of the molten metal.

In accordance with the present invention, as illustrated in the first preferred embodiment shown in FIGS. 1–3, the swirling tank reactor 10 is provided with a first substantially cylindrical side wall portion 12 and a second downwardly converging side wall portion 14 beneath side wall portion 12 so as to form degassing chamber 16. In accordance with the present invention, the downwardly converging side wall portion 14 is provided on its circumferential surface with a plurality of fluxing gas inlet nozzles 32 for introducing a fluxing gas into the molten metal as it passes through chamber 16 from the tangential inlet 18 to the outlet 20. In order to obtain optimized bubble dispersion through the entire melt as it passes from the inlet to the outlet the nozzles 32 are positioned at different heights on the circumferential surface of side wall portion 14. In this manner, maximum fluxing gas bubble dispersion is achieved by locating the fluxing gas nozzles at various distances with respect to the central axis of the swirling tank reactor. For example, if the side wall portion 12 is 20 inches in diameter the optimum fluxing gas bubble dispersion may be obtained by locating a first set of fluxing gas nozzle tips at a radial distance of about 9 inches from the central axis of the swirling tank reactor and a second set of nozzle tips at a radial distance of about 6 inches from the central axis of the swirling tank reactor. In accordance with the present invention the efficiency of the degassing process is thereby optimized; that is, the kinetics of the adsorption reaction is maximized by optimizing the fluxing gas bubble dispersion. It should be appreciated that while both sets of fluxing gas nozzle tips are illustrated as being located in converging side wall portion 14, like results could be obtained by locating the first set of nozzle tips in side wall portion 12 and the second set of tips in side wall portion 14.

Figure 7:
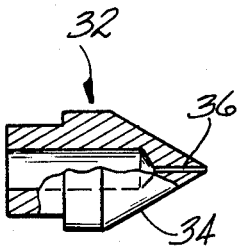
FIG. 7 illustrates the nozzle tip design for the fluxing gas nozzles used with the preferred apparatuses of the present invention.

In accordance with the present invention, as illustrated in FIG. 7, it is preferred that the fluxing gas nozzle tip be conical in shape so as to prevent deposit build up in the orifice of the nozzle which can lead to clogging of the same. Referring to FIG. 7, nozzle tip 32 is illustrated having a diverging conical tip portion 34 and orifice 36. The orifice size in the nozzle tip is made as small as possible consistent with preventing plugging of the orifice of the nozzle tip with molten metal. In accordance with the present invention, the orifice size may range from 0.005 inch to 0.075 and the preferred range being from 0.010 inch to 0.050 inch. It is preferred that the diverging portion 34 of nozzle tip 32 form with the axes of the orifice 36 an angle of from about 10° to 60° and preferably 20° to 40°.

Figure 4:
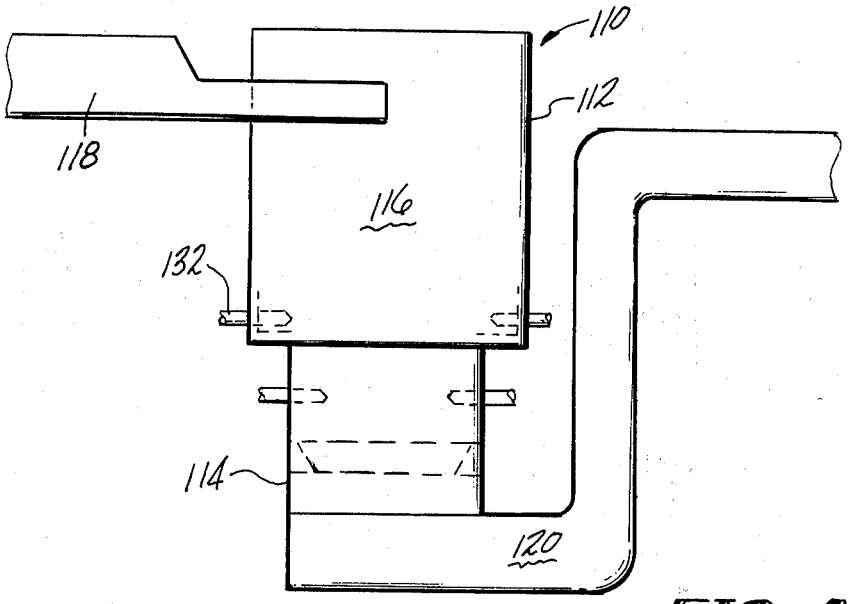
FIG. 4 is a schematic side view of a second embodiment of an apparatus in accordance with the present invention.

FIG. 4 illustrates a second embodiment of a swirling tank reactor in accordance with the present invention wherein the swirling tank reactor 110 comprises a first cylindrical side wall portion 112 and a second cylindrical side wall portion 114 which together form degassing chamber 116. In the same manner as previously discussed with regard to FIGS. 1–3 the degassing chamber 116 is provided with a tangential inlet 118 at the top thereof and an outlet 120 at the bottom thereof. Molten metal is introduced into degassing chamber 116 through tangential inlet 118 and flows in a swirling rotating fashion through chamber 116 from the inlet 118 to the outlet 120. If desired, filter means may be located in the bottom of side wall portion 114 above and proximate to the outlet 120 in the same manner and by the same means as discussed above with regard to the first embodiment of the present invention.

In accordance with the present invention, in order to achieve optimum fluxing gas bubble dispersion, a first set of conical nozzle tips 132 as illustrated in FIG. 7 are provided in side wall portion 112 in the swirling tank reactor 110 and a second set of fluxing gas nozzle tips 132 are provided in the second side wall portion 114 of the swirling tank reactor 110. It has been found that maximum fluxing gas bubble dispersion can be obtained by locating the tips in such a manner. For example, if the diameter of side wall portion 112 is in the order of 18 inches to 20 inches the diameter of second side wall portion 114 should be in the order of 10 inches to 12 inches.

Figure 5:
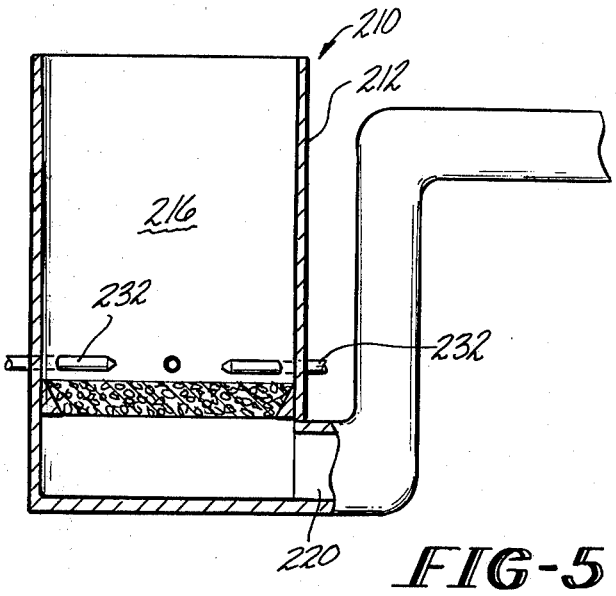
FIG. 5 is a schematic sectional side view of a third embodiment of an apparatus in accordance with the present invention.
Figure 6:
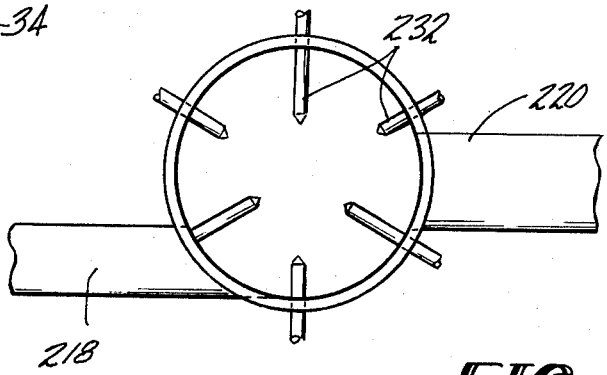
FIG. 6 is a schematic top view of the embodiment of FIG. 5.

FIGS. 5 and 6 illustrate a third embodiment in accordance with the present invention wherein a swirling tank reactor 210 comprises a substantially cylindrical side wall portion 212 forming fluxing gas chamber 216 having a tangential inlet 218 and an outlet 220. As discussed above with regard to the embodiments of FIGS. 1 and 4 molten metal tangentially enters fluxing chamber 216 from tangential inlet 218 and flows in a swirling rotating fashion through chamber 216 and out the outlet 220. Filter means may be provided in the bottom of chamber 216 proximate to the outlet 220 in the same manner as discussed with the embodiment of FIGS. 1–3. In accordance with the present invention, the preferred fluxing gas nozzle tips illustrated in FIG. 7 are provided in two sets in the side wall 212 of swirling tank reactor 210. In order to achieve the desired fluxing gas bubble dispersion, a first set of tips 232 are located at a first radial distance from the central axis of the swirling tank and a second set of nozzles are located at a second radial distance from said central axis. In this manner, the fluxing gas bubble dispersion may be maximized thereby optimizing the overall efficiency of the degassing operation.

The fluxing gas which may be employed in the present apparatuses and method comprises a wide variety of well known components including chlorine gas and other halogenated gaseous material, carbon monoxide as well as certain inert gas mixtures derived from and including nitrogen, argon, helium or the like. A preferred gas mixture for use in the present invention for degassing molten aluminum and aluminum alloys comprises a mixture of nitrogen or argon with dichlorodifluoromethane from about 2 to about 20% by volume, preferably 5 to 15% by volume. Another preferred gas mixture consists of preferably 2 to 10% by volume chlorine with nitrogen or argon. In conjunction with these gas mixtures, a gaseous protective cover of argon, nitrogen or the like may be used over the molten metal so as to minimize readsorption of gaseous impurities at the surface of the melt.

A preferred embodiment of the present invention calls for the provision of a filter-type medium positioned within the cylindrical chamber or downstream thereof. Accordingly, the filter-type medium comprises a filter medium such as that illustrated in FIG. 3. The filter medium possesses an open cell structure, characterized by a plurality of interconnected voids, such that the molten metal may pass therethrough to remove or minimize entrained solids from the final cast product. Such a filter may comprise, for example, a solid filter medium made from sintered ceramic aggregate, or a porous carbon medium. In the preferred embodiment, a ceramic foam filter is utilized as described in U.S. Pat. No. 3,962,081 and may be prepared in accordance with the general procedure outlined in U.S. Pat. No. 3,893,917, both of which U.S. patents are incorporated herein by reference. In accordance with the teachings of said U.S. patents, the ceramic foam filter has an air permeability in the range of from 400 to $8{,}000\times10^{-7}$ $cm^2$, preferably from 400 to $2{,}500\times10^{-7}$ $cm^2$, a porosity or void fraction of 0.80 to 0.95 and from 5 to 45 pores per linear inch, preferably from 20 to 45 pores per linear inch. The molten metal flow rate through the filter may range from 5 to 50 cubic inches per square inch of filter area per minute.

In the instance where the filter medium of the present invention is designed to be a throwaway item, it is essential to provide an effective means of sealing the filter medium. It is greatly preferred to seal the filter medium in place using a resilient sealing means as discussed earlier, which peripherally circumscribes the filter medium at the bevelled portion thereof. The resilient sealing means should be non-wetting to the particular molten metal, resist chemical attack therefrom and be refractory enough to withstand the high operating temperatures. Typical seal materials utilized in aluminum processing include fibrous refractory type seals of a variety of compositions, as the following illustrative seals: (1) a seal containing about 45% alumina, 52% silica, 1.3% ferric oxide and 1.7% titania; (2) a seal containing about 55% silica, 40.5% alumina, 4% chromia and 0.5% ferric oxide; and (3) a seal containing about 53% silica, 46% alumina and 1% ferric oxide.

In a preferred embodiment, the nozzles employed in the present invention should be constructed of a refractory material resistant to molten metal. Suitable materials include but are not limited to graphite, alumina and the like.

The dimensions of the swirling tank reactor, the number of nozzles and the amount of fluxing gas employed depends greatly upon the flow rate of the metal to be treated. It has been found that for flow rates of 500 pounds per minute the diameter of the fluxing chambers 16, 116 and 216 respectively as defined by side wall portions 12, 112 and 212, respectively, should be about 18 to 20 inches in diameter with the length of the chambers from the metal inlet to the metal outlet being in the order of 2 to 6 feet. For a swirling tank reactor of the dimensions noted above it has been found that in order to achieve maximum fluxing gas bubble dispersion and thereby optimize the efficiency of the degassing apparatus a first set of three nozzle tips should be located at a radius of about 8 inches to 9½ inches in the central axis of the reactor and a second set of three nozzle tips be located at a radius of about 5 inches to 6½ inches from the central axis. It has been found that in order to achieve optimized fluxing gas bubble dispersion the nozzles should be located substantially perpendicular to the tangent of the points along the circumference of the wall portion of the cylinder. It should be appreciated that the nozzles may be mounted in pivotable ball-joints in the side wall of the tank reactor so as to allow for angular adjustments. Furthermore, the nozzles may be mounted so as to enable the same to be radially adjusted with respect to the central axis of the swirling tank reactor.

The following example is illustrative of the present invention.

EXAMPLE

The swirling tank reactor as illustrated in FIG. 4 having an internal chamber diameter of 18 inches was located in an existing molten metal transfer system. Six fluxing gas nozzle tips were employed in the side wall portion of the swirling tank reactor. A first set of three nozzles extended 2½ inches into the reactor and an alternate second set of nozzle tips extended approximately ½ inch into the tank reactor. A melt of molten metal was passed through the fluxing chamber at a flow rate of 500 pounds per minute. A fluxing gas mixture of 6% by volume dichlorodifluoromethane in argon was introduced into the melt through the nozzles at a total flow rate of 70 liters per minute (measured at standard temperature and pressure conditions). The axis of the orifice nozzles formed an angle of 90° with the tangent of the side wall portion of the cylindrical chamber. The inlet hydrogen levels of the molten metal was measured at 0.23 cc hydrogen per 100 grams of aluminum. After treatment in a swirling tank reactor the hydrogen level was reduced to 0.17 cc of 100 grams of aluminum as measured by the Alcoa Telegas instrument. This represents a substantial decrease in hydrogen content thus illustrating the efficiency of the degassing operation.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An improved apparatus for use in the degassing of molten metal which comprises:

chamber means having an elongated side wall portion and a central axis;

inlet means at a first height for introducing said molten metal into said chamber;

outlet means at a second height below said first height for removing said molten metal from said chamber;

at least two fluxing gas inlet means located below said first height for introducing said fluxing gas into said chamber, said first fluxing gas inlet means being located at a first radial distance from said central axis of said chamber means and said second fluxing gas inlet means being located at a second radial distance from said central axis of said chamber means; and wherein said molten metal inlet means is located with respect to said side wall portion for tangentially introducing said molten metal into said chamber such that said molten metal swirlingly flows from said molten metal inlet towards said molten metal outlet as said fluxing gas percolates up through said molten metal.

2. An apparatus according to claim 1 wherein said elongated side wall portion comprises a first part having a first diameter and a second part located beneath said first part.

3. An apparatus according to claim 2 wherein said second part is in the form of a downwardly converging side wall portion.

4. An apparatus according to claim 2 wherein said second part is substantially cylindrical in form and has a diameter smaller than said first diameter.

5. An apparatus according to claim 3 wherein said first fluxing gas inlet means is located in said first part of said elongated side wall portion and said second fluxing gas inlet means is located in said second part of said elongated side wall portion.

6. An apparatus according to claim 3 wherein both said first and said second fluxing gas inlet means are located in said second part of said elongated side wall portion at different heights below said first height.

7. An apparatus according to claim 4 wherein said first fluxing gas inlet means is located in said first part of said elongated side wall portion and said second fluxing gas inlet means is located in said second part of said elongated side wall portion.

8. An apparatus according to claim 5 wherein each of said first and said second fluxing gas inlet means comprises at least one conical shaped nozzle tip.

9. An apparatus according to claim 6 wherein each of said first and said second fluxing gas inlet means comprises at least one conical shaped nozzle tip.

10. An apparatus according to claim 7 wherein each of said first and said second fluxing gas inlet means comprises at least one conical shaped nozzle tip.

11. An apparatus according to claim 5 wherein each of said first and said second fluxing gas inlet means comprises three conical shaped nozzle tips.

12. An apparatus according to claim 6 wherein each of said first and said second fluxing gas inlet means comprises three conical shaped nozzle tips.

13. An apparatus according to claim 7 wherein each of said first and said second fluxing gas inlet means comprises three conical shaped nozzle tips.

14. An apparatus according to claim 8 wherein said at least one nozzle tip has an orifice, said orifice size range from 0.005 inch to 0.075 inch.

15. An apparatus according to claim 9 wherein said at least one nozzle tip has an orifice, said orifice size range from 0.005 inch to 0.075 inch.

16. An apparatus according to claim 10 wherein said at least one nozzle tip has an orifice, said orifice size range from 0.005 inch to 0.075 inch.

17. An apparatus according to claim 8 wherein said at least one nozzle tip has an orifice, said orifice size range from 0.010 inch to 0.050 inch.

18. An apparatus according to claim 9 wherein said at least one nozzle tip has an orifice, said orifice size range from 0.010 inch to 0.050 inch.

19. An apparatus according to claim 10 wherein said at least one nozzle tip has an orifice, said orifice size range from 0.010 inch to 0.050 inch.

20. An apparatus according to claim 1 wherein said chamber means has inside wall surfaces adapted to support a removable filter-type medium at a fourth height in said chamber above said second height and below said first height.

21. An apparatus according to claim 20 wherein said filter medium is a ceramic foam filter having an open cell structure characterized by a plurality of interconnected voids surrounded by a web of ceramic.

22. An apparatus according to claim 21 wherein said ceramic foam filter medium has an air permeability in the range of 400 to $8{,}000\times10^{-7}$ cm$^2$, a porosity of 0.80 to 0.95 and a pore size of from 5 to 45 ppi.

23. An apparatus according to claim 5 wherein said chamber means has inside wall surfaces adapted to support a removable filter-type medium at a fourth height in said chamber above said second height and below said first height.

24. An apparatus according to claim 23 wherein said filter medium is a ceramic foam filter having an open cell structure characterized by a plurality of interconnected voids surrounded by a web of ceramic.

25. An apparatus according to claim 24 wherein said ceramic foam filter medium has an air permeability in the range of 400 to $8{,}000\times10^{-7}$ cm$^2$, a porosity of 0.80 to 0.95 and a pore size of from 5 to 45 ppi.

26. An apparatus according to claim 6 wherein said chamber means has inside wall surfaces adapted to support a removable filter-type medium at a fourth height in said chamber above second height and below said first height.

27. An apparatus according to claim 26 wherein said filter medium is a ceramic foam filter having an open cell structure characterized by a plurality of interconnected voids surrounded by a web of ceramic.

28. An apparatus according to claim 27 wherein said ceramic foam filter medium has air permeability in the range of 400 to $8{,}000\times10^{-7}$ cm$^2$, a porosity of 0.80 to 0.95 and a pore size of from 5 to 45 ppi.

29. A method for degassing of molten metal by passing said molten metal through a chamber and purging said molten metal with a fluxing gas by passing said fluxing gas through said metal, the improvement comprising providing a chamber having an elongated side wall portion and a central axis, providing said chamber with molten metal inlet means at a first height, molten metal outlet means at a second height below said first height and at least two fluxing gas inlet means below said first height, positioning said first fluxing gas inlet means at a first radial distance from said central axis and positioning said second fluxing gas inlet means at a second radial distance from said central axis, tangentially positioning said molten metal inlet means with respect to said side wall portion such that said molten metal swirlingly flows from said molten metal inlet to said molten metal outlet as said fluxing gas percolates through said molten metal.

30. The method of claim 29 comprising positioning said fluxing gas inlet means such that the axes thereof intersect said side wall portion at a plurality of points along the circumference thereof and form with the tangents of said points an angle of about 90°.

* * * * *

UNITED STATES PATENT AND TRADEMARK OFFICE

CERTIFICATE OF CORRECTION

PATENT NO. : 4,177,066

DATED : December 4, 1979

INVENTOR(S) : Joseph A. Clumpner

It is certified that error appears in the above-identified patent and that said Letters Patent are hereby corrected as shown below:

Column 1, line 43, change "aircrafts" to --aircraft--.

Column 6, line 1, after "octagonal" insert --in--.

Column 7, line 13, after "0.075" insert --inch--.

Column 12, line 13, claim 28, after "has" insert --an--.

Column 12, line 16, claim 29, after "for" insert --the--.

Signed and Sealed this

*Thirteenth* Day of *May 1980*

[SEAL]

*Attest:*

SIDNEY A. DIAMOND

*Attesting Officer*

*Commissioner of Patents and Trademarks*